United States Patent [19]

Ewald

[11] Patent Number: 4,732,076

[45] Date of Patent: Mar. 22, 1988

[54] APPARATUS FOR THE CONTROL OF A HYDROMOTOR

[75] Inventor: Roland Ewald, Lohr/Main, Fed. Rep. of Germany

[73] Assignee: G. L. Rexroth GmbH, Lohr/Main, Fed. Rep. of Germany

[21] Appl. No.: 347,723

[22] Filed: Feb. 10, 1982

Related U.S. Application Data

[63] Continuation of Ser. No. 134,052, Mar. 26, 1980, abandoned.

[30] Foreign Application Priority Data

Mar. 26, 1979 [DE] Fed. Rep. of Germany ..... 2911891

[51] Int. Cl.[4] ..... F15B 11/04

[52] U.S. Cl. ..... 91/420; 60/460

[58] Field of Search ..... 91/420; 60/460

[56] References Cited

U.S. PATENT DOCUMENTS 1,974,138 9/1934 Ferris et al. ..... 91/420
2,431,032 11/1947 Ernst ..... 91/420
3,601,235 8/1971 Huf ..... 60/460
4,132,153 11/1979 Grotness et al. ..... 91/420
4,240,255 12/1980 Benilan ..... 60/460

FOREIGN PATENT DOCUMENTS 1776190 10/1978 Fed. Rep. of Germany .

OTHER PUBLICATIONS

Rexroth Publication-Re. 27550, 8 pages, Jan. 1979.

*Primary Examiner*—Deborah L. Kyle
*Assistant Examiner*—Richard L. Klein
*Attorney, Agent, or Firm*—Roylance, Abrams, Berdo & Goodman

[57] ABSTRACT

A compensating valve arrangement is connected between a throttling direction control valve or proportioning valve which controls fluid flow from a pressure source to a load. The compensating valve is provided with a pressure reducing valve, check valves and throttling points between the pressure supply and the control piston of the compensating valve to compensate for surges, prevent sudden driving of the load and prevent leakage.

4 Claims, 1 Drawing Figure

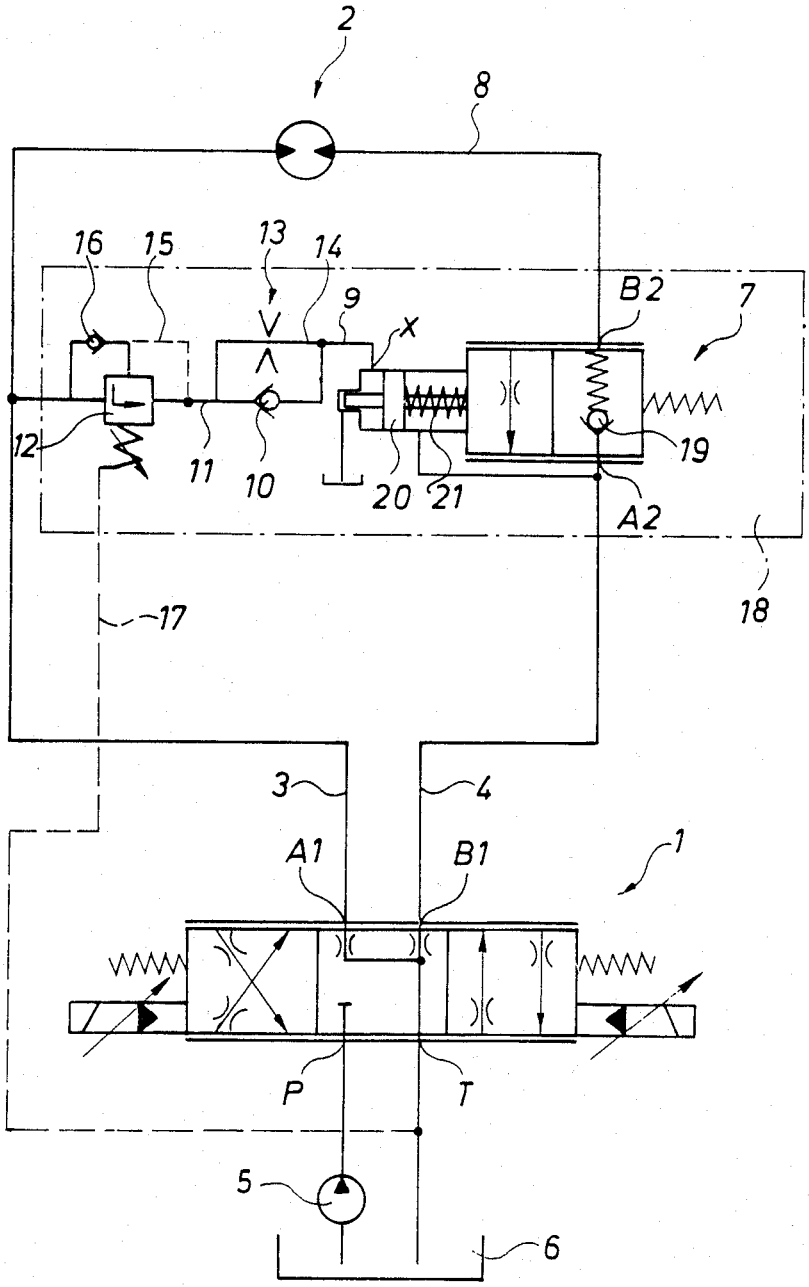
2
8
16
15
13
14
9
B2
7
X
12
11
10
20
21
19
A2
18
17
3
4
A1
B1
1
P
T
5
6

APPARATUS FOR THE CONTROL OF A HYDROMOTOR

This is a continuation of application Ser. No. 134,052, filed Mar. 26, 1980, now abandoned.

This invention relates to an apparatus for controlling the application of a fluid under pressure to a hydraulic load device.

BACKGROUND OF THE INVENTION

It is known in the prior art to provide an equalization or compensating arrangement between a pressure source and a hydraulic load in which the equalization device is in the form of a pressure balancing device. A pressure balancing device has a disadvantage that it is fully opened when the hydromotor is separated from the pressure agent source. Thus, when the hydromotor is initially connected to the pressure agent source there is a disadvantageous surge of fluid under pressure and the result is a starting jump of the hydromotor because, at the beginning of operation, open paths for the pressure agent must be reduced in their cross section, or possibly closed altogether. An arrangement of this type is shown in German AS No. 1,650,312.

BRIEF DESCRIPTION OF THE INVENTION

An object of the present invention is to provide an apparatus which avoids a sudden application of fluid pressure to a hydromotor upon connection of the hydromotor with a source of fluid under pressure.

Briefly described, the invention includes, in an apparatus for controlling the application of fluid under pressure to a hydraulic load device, which apparatus includes a source of fluid under pressure, a throttling direction control valve for selectively permitting the pressure fluid to flow to the load, and conduit means for interconnecting the source, valve and load device, the improvement comprising compensating valve means for preventing sudden driving of the load, for maintaining constant load device speed substantially independent of load changes independently of direction, and for closing without leaking agent, said compensating valve means having a control input, and a pressure relief valve connected between the load device and the control input of said compensating valve means.

As will be seen from the following description, the load compensating valve is closed whenever the hydromotor is separated from the pressure agent source and is opened only when the hydromotor is connected to the source. Moreover, the load compensating valve closes the passage for the pressure agent free of leakage and prevents the lead of loads in case of a double-acting hydromotors such as, for example, a double-acting operating cylinder. The arrangement of the pressure reducing valve makes possible the maintaining of a constant pressure between two connecting lines of the proportioning valve, namely, between the connecting line from the load and one leading to the supply tank. The apparatus may be combined in a single device and manufactured at an advantageous cost.

Additionally, the invention contemplates providing a connection between the tank side of the proportioning valve and the pressure reducing valve such that the pressure difference in the supply tank controlled by the load compensating valve at the throttling direction control valve or proportioning valve will remain constant even in the case of changing pressure.

The apparatus can further include a check valve, openable for flow in the direction of the compensating valve means, between that valve means and the pressure reducing valve to permit a quick opening of the primary passage of the load compensating valve and a slow closing of the passage.

Further, the apparatus can include a second check valve, openable for flow toward the load device, between the control line of the pressure reducing valve and the conduit connecting the pressure reducing valve with the load device to permit quick reduction of the pressure at the control connection point of the load compensating valve.

In order that the manner in which the foregoing and other objects are attained in accordance with the invention can be understood in detail, a particularly advantageous embodiment thereof will be described with reference to the accompanying drawing which forms a part of this specification and which comprises a schematic diagram, in the form of a fluid circuit diagram, illustrating the invention.

As shown in the drawing, a throttling four port, 3-way valve 1 is contructed as an electro-hydraulic servo valve, also called a proportioning valve, as described for example in German AS No. 1,776,190. Valve 1 has two ports A 1 and B 1, connectable with a hydraulic load device illustrated as a hydromotor 2 which has constant displacement volume and with a direction of flow. The device can be an operating cylinder or some similar device with which supply lines 3 and 4 are to be connected. A connection P at valve 1 is connected to the output of a pump 5 and a connection T of the proportioning valve is connected to the return to a supply tank 6. The device described has s single supply tank 6 for all pertinent devices.

The slide or movable member of the 3-way valve 1, can be controlled by means of an electromagnet. The position of the armature of the magnet depends on the applied voltage. Thus, the movable member of the valve 1 is infinitely variable rather than having three definite positions, and the flows through the valve are throttled, as shown in the drawing.

Conduit 3 leads directly to the hydromotor 2, and conduit 4 leads to a connection A 2 on a load compensating valve 7, the connection B 2 of which is connected to the hydromotor through a conduit 8. The load compensating valve is preferrably constructed as a check-Q-meter valve of the type manufactured by G. L. Rexroth GmbH, Jahnstrasse, D 8770 Lohr-Main, West Germany, and described in publication RE 27550 of January, 1979.

The load compensating valve has a control connection X which is connected by a conduit 9 with a check valve 10 openable toward the connection point X. This check valve 10 is connected through a line 11 with a pressure reducing valve 12, the other side of which is connected to conduit 3.

Check valve 10 can be bypassed by way of a bypass line 14, which is provided with a throttling aperture at 13 which is a constant viscosity throttling place. The pressure reducing valve 12 has a control line 15 which is connected to line 11. The control line 15 is connected to conduit 3 by way of a check valve 16, openable to flow in the direction toward conduit 3. A control flow line 17 of the pressure reducing valve 12, is connected to supply tank 6.

The load compensating valve 7, the check valve 10, together with throttle 13 and pressure reducing valve 12 together with control line 15 and check valve 16 can be accommodated in a single housing 18, indicated by dash-dot lines, which is conveniently constructed as a multi-part housing.

Load compensating valve 7 has a main poppet valve member 19 and a control piston 20 which operates the poppet valve, piston 20 being acted upon by fluid supply from connections X and A 2 which have equal cross sections. A compression spring 21 is disposed between the side of control piston 20 which is facing toward valve member 19 and the housing of valve 7. When hydromotor 2 is operated in one direction, proportioning valve 1 connects line 4 with pump 5 such that pressure agent flows through valve 7 and line 8 to hydromotor 2, and line 3 functions as a return line. When hydromotor 2 is operated in the opposite direction, proportioning valve 1 connects line 3 with pump 5 such that pressure agent flows through line 3 to hydromotor 2, lines 8 and 4 function as return lines, and pressure. Reducing valve 12 keeps the pressure constant at the connection X of the valve 7. Thus, the pressure at connection A 2 of valve 7 also remains constant since the control piston 20 is always acted upon with the same cross sectional areas from the two connections X and A 2 of valve 7. The pressure at connection A 2 corresponds to the difference between the pressure at the control connection X and the pressure which is required to overcome the pre-existing force of spring 21. If, for example, a pressure of 10 bar is required at connection X in order to move control piston 20 counter to the force of spring 21, and if there is a pressure of 30 bar at connection X of the load compensating valve, then the pressure at the connection A 2 of valve 7 amounts to 20 bar.

The pressure gradient between the connections B 1 and T of throttling direction control valve or proportioning valve 1 is kept constant with the help of the previously described device. Load compensating valve 7 acts somewhat like a pressure balancing device and reduces the excess pressure between the connections A 2 and B 2. In the opening position of the main valve member 19 of valve 7, practically no drop in pressure occurs between connections A 2 and B 2 upon passage of the pressure agent through valve 7.

Because of the connection of pressure reducing 12 with supply tank 6 by way of control flow line 17, the fluctuations in pressure in the supply tank act in such a way on the pressure reducing valve that the pressure at connection X of the load compensating valve is changed such that the pressure gradient between connections B 1 and T of proportioning valve 1 remains constant.

The arrangement of check valve 10, of the bypass line 14 bypassing said valve, and of the aperture 13 inserted therein, act in wuch a way that control piston 20 is moved in the direction of control of the main valve member 19 quickly, since there is a full passage between lines 9 and 11, and the extended control piston 20 returns toward its rest position only slowly since the return flow is throttled by opening 13.

The connection of the control line 15 of the pressure reducing valve 12 by way of check valve 16 with line 3 makes possible, in the event of a quick drop of pressure in line 3, flowing of the pressure agent from control line 15 into line 3, as a result of which the pressure at connecting point X of valve 7 can be quickly reduced.

The advantage of the use of a load compensating valve 7 of the kind described includes the fact that the valve acts as a pressure balancing device for loads, independently of their direction, in that the latter prevents any leading of loads, and in that its main valve member blocks the passage of the pressure agent monitored by it, free of leakage agent, since the main valve member is developed in the form of a cone on its seat.

The term "hydromotor" will be understood to include a working cylinder.

While one advantageous embodiment has been chosen to illustrate the invention it will be understood by those skilled in the art that various changes and modifications can be made therein without departing from the scope of the invention as defined in the apended claims.

What is claimed is;

1. In an apparatus for controlling the application of fluid under pressure to a hydraulic load device, the apparatus including a source of fluid under pressure, a throttling direction control valve for selectively permitting the pressure fluid to flow to the load device, first conduit means for interconnecting the load device at a first port thereof and the direction control valve, and second and third conduit means for interconnecting the direction control valve and the load device at a second port thereof;

compensating valve means, connected between said second and third conduit means such that said second conduit means connects said compensating valve means and the direction control valve and said third conduit means connects the load device and the compensating valve means, for preventing sudden driving of the load device for maintaining constant load device speed in the case of load changes thereon indepedently of direction, and for closing without leaking pressure fluid, said compensating valve means having a control input and a control piston with means for connecting said control piston with said control input; the improvement comprising a pressure reducing valve having input and output flow connections, a control connection, means for connecting said input flow connection with the first conduit means and means for connecting said output flow connection with said control input of said compensating valve means, said control connection being on the side of said pressure reducing valve and having means for connecting said control connection to said control input of said compensating valve means, whereby the pressure of fluid supplied to said control input of the compensating valve means, the pressure gradient across the direction control valve and the flow through the direction control valve are maintained substantially constant when the source of fluid under pressure is connected to the first conduit means;

fourth conduit means connecting the side of the control piston opposite the control input with the second conduit means; and spring means for biasing the control piston toward the control input.

2. An apparatus according to claim 1 wherein said pressure reducing valve additionally includes a control spring means connected to fifth conduit means interconnecting the throttling direction control valve and a supply tank.

3. An apparatus according to claim 1 or 2 and including a first check valve between the control input of said compensating valve means and said pressure reducing valve, said first check valve openable for flow in the direction of said compensating valve means; and a throttling conduit bypassing said check valve.

4. An apparatus according to claim 1 or 2 and including a second check valve between said control connection of said pressure reducing valve and the first conduit means connecting said pressure reducing valve with said load device, said second check valve being openable for flow toward the load device.

* * * * *